US008446406B2

(12) United States Patent
Min et al.

(10) Patent No.: US 8,446,406 B2
(45) Date of Patent: May 21, 2013

(54) LIQUID CRYSTAL DISPLAY

(75) Inventors: Woongki Min, Daegu (KR); Hongsung Song, Kyungbuk (KR); Donghak Lee, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 792 days.

(21) Appl. No.: 12/627,486

(22) Filed: Nov. 30, 2009

(65) Prior Publication Data

US 2011/0001749 A1 Jan. 6, 2011

(30) Foreign Application Priority Data

Jul. 3, 2009 (KR) ..... 10-2009-0060803

(51) Int. Cl.
*G09G 5/00* (2006.01)
*G09G 3/36* (2006.01)

(52) U.S. Cl.
USPC ..... 345/214; 345/92

(58) Field of Classification Search
USPC ..... 345/76, 87, 89, 92, 98, 100, 214
See application file for complete search history.

(56) References Cited

U.S. PATENT DOCUMENTS

| | | | | |
|---|---|---|---|---|
| 7,116,300 | B2 * | 10/2006 | Kageyama et al. | 345/89 |
| 7,433,008 | B2 * | 10/2008 | Kim | 349/152 |
| 2006/0139291 | A1 * | 6/2006 | Cho et al. | 345/100 |
| 2008/0111781 | A1 * | 5/2008 | Bae | 345/89 |

* cited by examiner

*Primary Examiner* — Joseph Haley
*Assistant Examiner* — Andrew Sasinowski
(74) *Attorney, Agent, or Firm* — Morgan, Lewis & Bockius LLP

(57) ABSTRACT

A liquid crystal display is disclosed. The liquid crystal display includes a liquid crystal display panel including data lines and gate lines crossing one another and a pixel array including liquid crystal cells arranged in a matrix format according to a crossing structure of the data lines and the gate lines, a source drive circuit supplying a data voltage to the data lines through a plurality of output channels, a gate drive circuit sequentially supplying a gate pulse to the gate lines. The liquid crystal display panel includes link lines that respectively connect the data lines to the output channels of the source drive circuit. The source drive circuit includes a plurality of output channel resistors connected between the output channels and the link lines. Each of the output channel resistors includes a variable resistance circuit.

9 Claims, 11 Drawing Sheets

LIQUID CRYSTAL DISPLAY

This application claims the benefit of Korean Patent Application No. 10-2009-0060803 filed on Jul. 3, 2009, the entire contents of which is incorporated herein by reference for all purposes as if fully set forth herein.

BACKGROUND

1. Field

Embodiments of the document relate to a liquid crystal display capable of achieving uniform display quality using a source drive circuit having a plurality of output channels each having a different resistance.

2. Discussion of the Related Art

Active matrix type liquid crystal displays display a moving picture using a thin film transistor (TFT) as a switching element. The active matrix type liquid crystal displays have been implemented in televisions as well as display devices in portable devices, such as office equipment and computers, because of the thin profile of an active matrix type liquid crystal displays. Accordingly, cathode ray tubes (CRT) are being rapidly replaced by active matrix type liquid crystal displays.

A liquid crystal display generally includes a liquid crystal display panel, a backlight unit providing light to the liquid crystal display panel, source driver integrated circuits (ICs) supplying a data voltage to data lines of the liquid crystal display panel, gate driver ICs supplying a gate pulse (i.e., a scan pulse) to gate lines (i.e., scan lines) of the liquid crystal display panel, a control circuit controlling the source driver ICs and the gate driver ICs, a light source driving circuit driving a light source of the backlight unit, and the like.

In the liquid crystal display, the size of each source driver IC is much smaller than the size of a portion of a pixel array driven by each source driver IC. Further, a pitch between output channels of the source driver ICs is smaller than a pitch between the data lines. Because of this, as shown in FIG. 1, link lines LINK are formed between output channels of source driver ICs SIC and data lines of a pixel array PIXA to respectively connect the output channels of the source driver ICs SIC to the data lines. A length of the link lines LINK increases as a distance between the output channels of the source driver ICs SIC and the data lines increases. Accordingly, a resistance (hereinafter referred to as a "link resistance") of the link line LINK increases as the link line LINK goes to both ends of the pixel array PIXA. According to an experimental result of resistance measurement, the link resistance may vary depending on the size and a resolution of the liquid crystal display panel. However, a difference between a minimum value and a maximum value of the link resistance may increase to several kΩ.

A voltage charge amount of liquid crystal cells of the pixel array PIXA varies depending on the link resistance. In other words, a voltage charge amount of the liquid crystal cell connected to the data line having a large link resistance is less than a voltage charge amount of the liquid crystal cell connected to the data line having a relatively small link resistance. The voltage charge amount of the liquid crystal cell is inversely proportional to the link resistance. As a result, because the voltage charge amount of the liquid crystal cell varies because of a deviation of the link resistances, it is difficult to display an image with uniform luminance throughout the pixel array.

SUMMARY

Embodiments of the document provide a liquid crystal display capable of achieving uniform display quality using a source drive circuit having a plurality of output channels each having a different resistance.

In one aspect, there is a liquid crystal display comprising a liquid crystal display panel including data lines and gate lines crossing one another and a pixel array including liquid crystal cells arranged in a matrix format according to a crossing structure of the data lines and the gate lines, a source drive circuit including a plurality of output channels, the source drive circuit supplying a data voltage to the data lines through the plurality of output channels, a gate drive circuit sequentially supplying a gate pulse to the gate lines, wherein the liquid crystal display panel includes link lines that respectively connect the data lines to the output channels of the source drive circuit, wherein the source drive circuit includes a plurality of output channel resistors connected between the output channels and the link lines, wherein each of the output channel resistors includes a variable resistance circuit.

Resistances of the output channel resistors are inversely proportional to resistances of the link lines.

The source drive circuit includes a circular integrated drive circuit chip supplying the data voltage to all of the data lines inside the pixel array.

The source drive circuit includes at least one source driver integrated circuit (IC) connected to the data lines through the output channels and a timing controller that supplies digital video data to the at least one source driver IC and generates a timing control signal for controlling an operation timing of the at least one source driver IC and an operation timing of the gate drive circuit.

Each of the circular integrated drive circuit chip and the at least one source driver IC includes a digital-to-analog converter converting the digital video data into the data voltage and an output circuit connecting an output of the digital-to-analog converter to the output channel resistors through an output buffer.

The output circuit includes a multichannel selection circuit that disables at least some of the output channels in response to a predetermined multichannel selection signal so that the at least some of the output channels serve as a dummy output channel.

The variable resistance circuit includes a multiplexer to which the data voltage is input through an input terminal of the multiplexer, a first resistor connected between a first output terminal of the multiplexer and the data lines, and a second resistor connected between a second output terminal of the multiplexer and the data lines. The multiplexer connects the input terminal to one of the first and second resistors in response to a predetermined resistance selection signal.

The variable resistance circuit includes a first resistor to which the data voltage is input, a multiplexer whose an input terminal is connected to the first resistor, and a second resistor connected to one of a plurality of output terminals of the multiplexer. The second resistor and another output terminal of the plurality of output terminals of the multiplexer are connected in series to the data line. The multiplexer connects the first resistor to one of the second resistor and the data line in response to a predetermined resistance selection signal.

A resistance of the first resistor is substantially equal to or different from a resistance of the second resistor.

Adjacent j, where j is an integer equal to or greater than 2 and less than 5, output channel resistors among the plurality of output channel resistors have the same resistance.

BRIEF DESCRIPTION OF THE DRAWINGS

The accompanying drawings, which are included to provide a further understanding of the document and are incorporated in and constitute a part of this specification, illustrate embodiments and together with the description serve to explain the principles.

In the drawings.

DETAILED DESCRIPTION OF THE EMBODIMENTS

Reference will now be made in detail to embodiments, examples of which are illustrated in the accompanying drawings.

Figure 1:
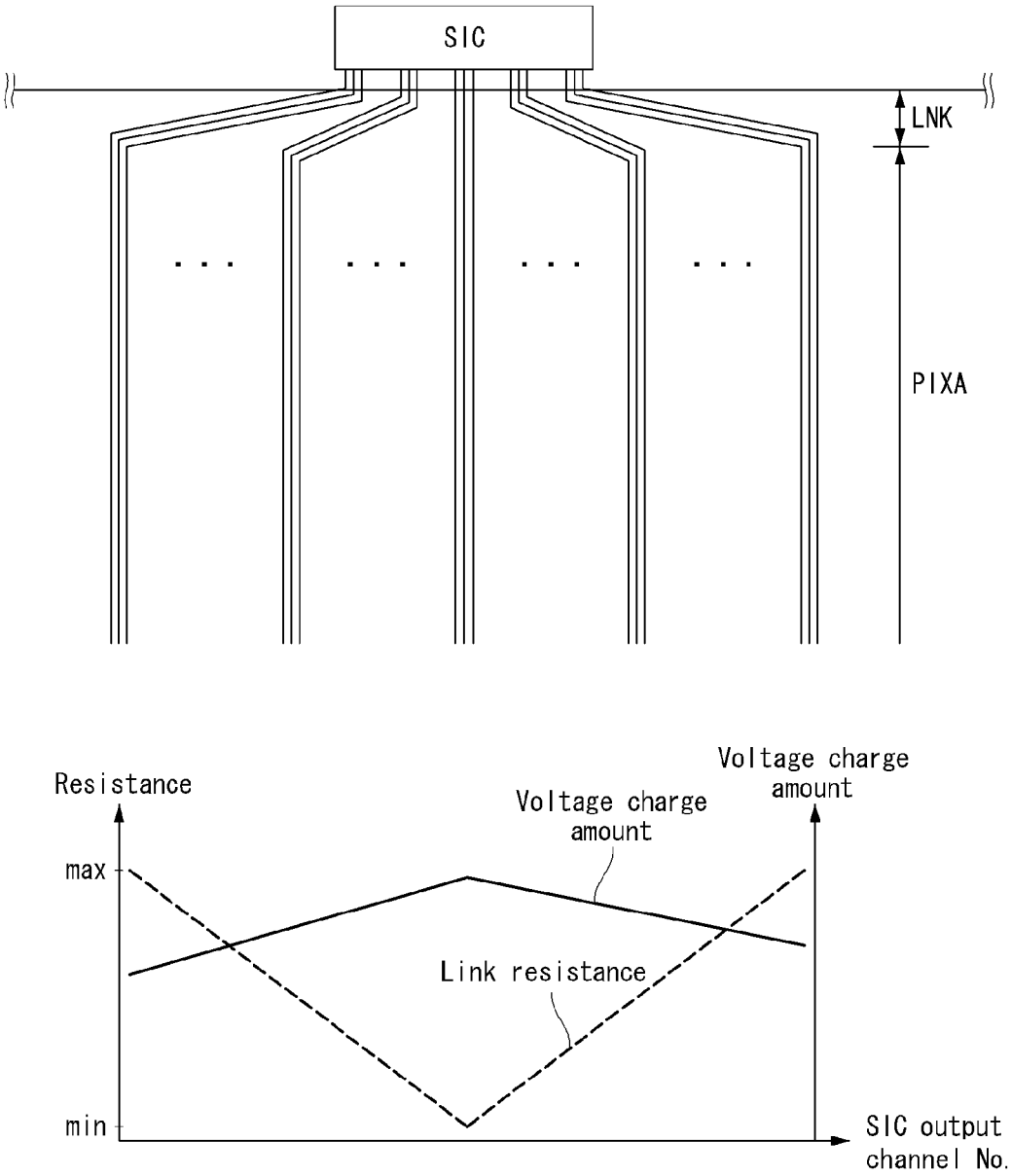
FIG. 1 (RELATED ART)
FIG. 1 illustrates a link resistance of a liquid crystal display panel.
Figure 2:
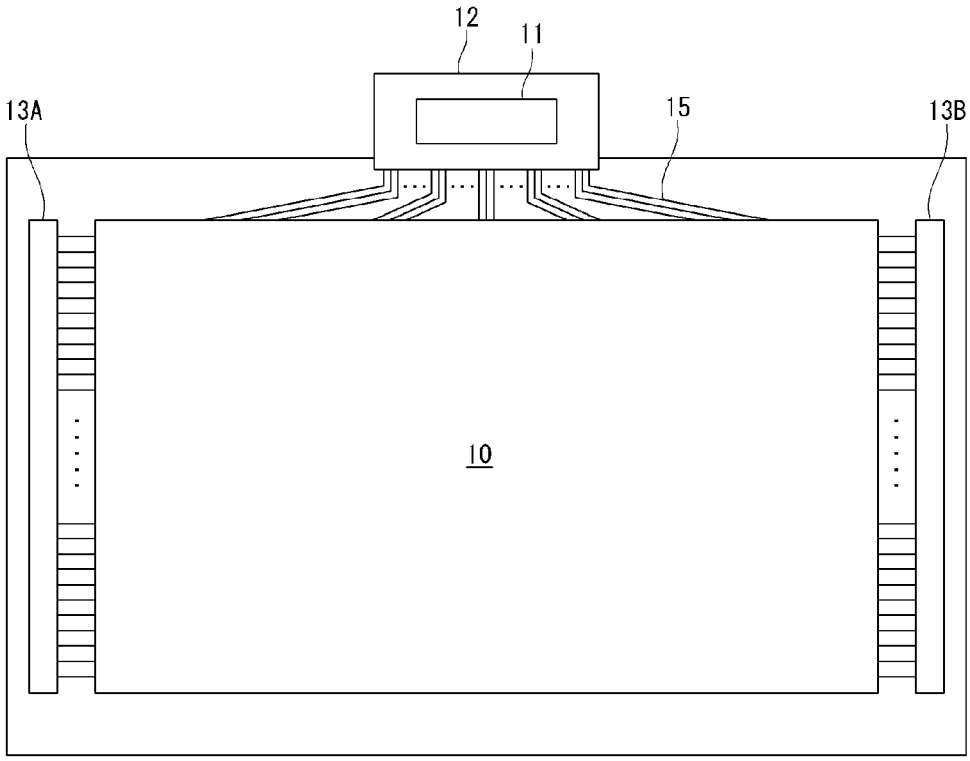
FIG. 2 illustrates a liquid crystal display according to an embodiment.

As shown in FIG. 2, a liquid crystal display according to an embodiment includes a liquid crystal display panel on which a pixel array 10 is formed, a circular integrated drive circuit chip 11, and gate drive circuits 13A and 13B. A backlight unit may underlie the liquid crystal display panel to uniformly provide light to the liquid crystal display panel.

Figure 4:
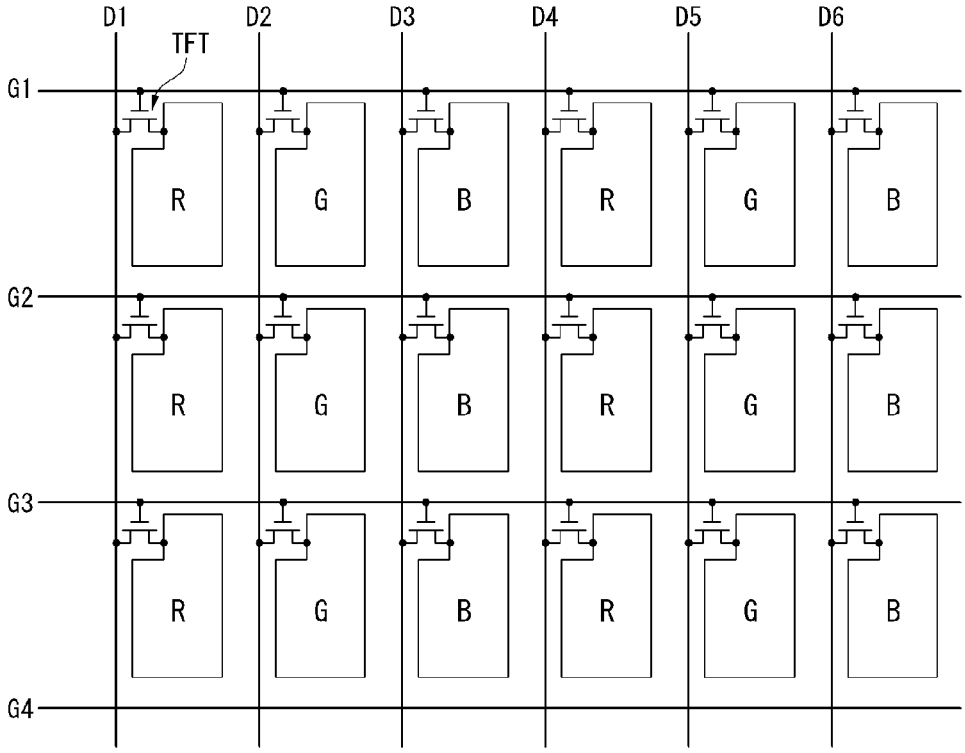
FIGS. 4 to 6 are circuit diagrams illustrating in detail a pixel array shown in FIGS. 2 and 3.
Figure 5:
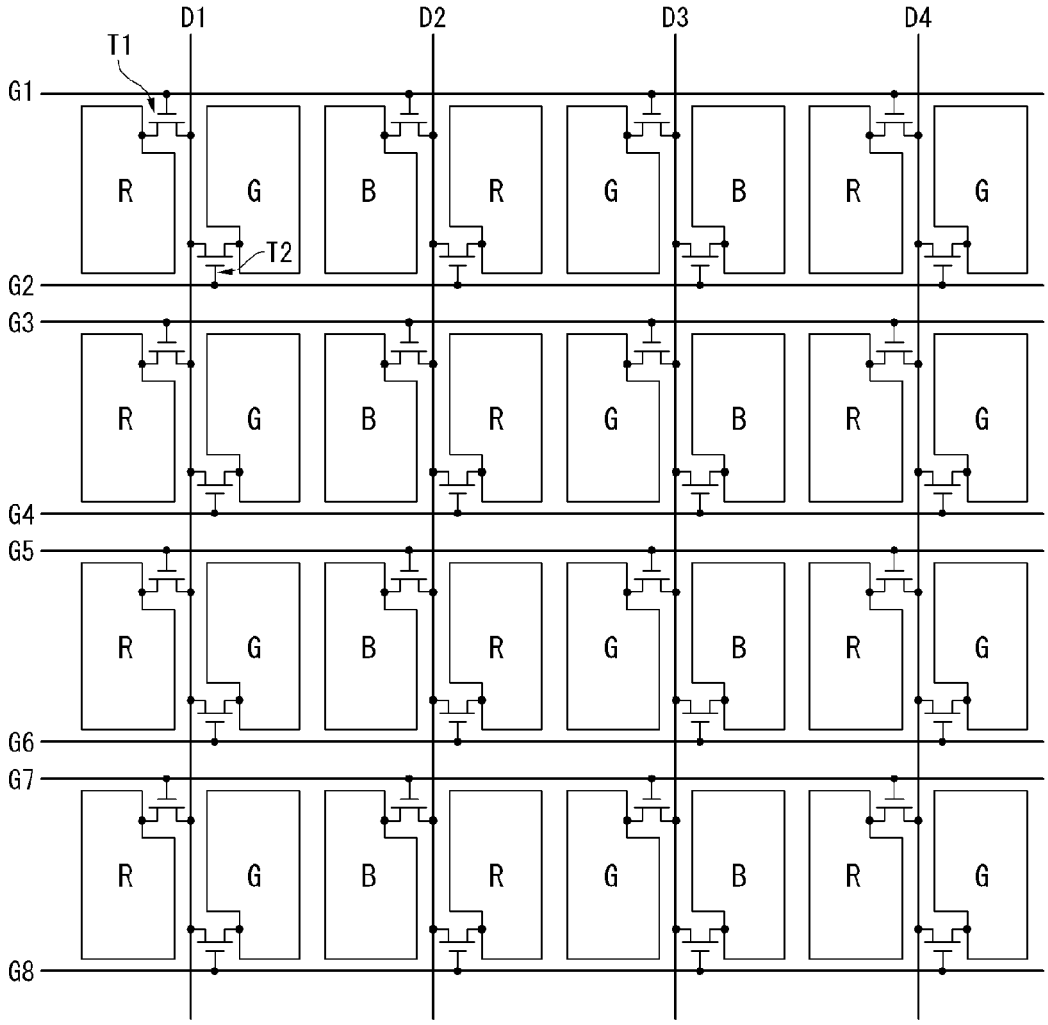
Figure 6:
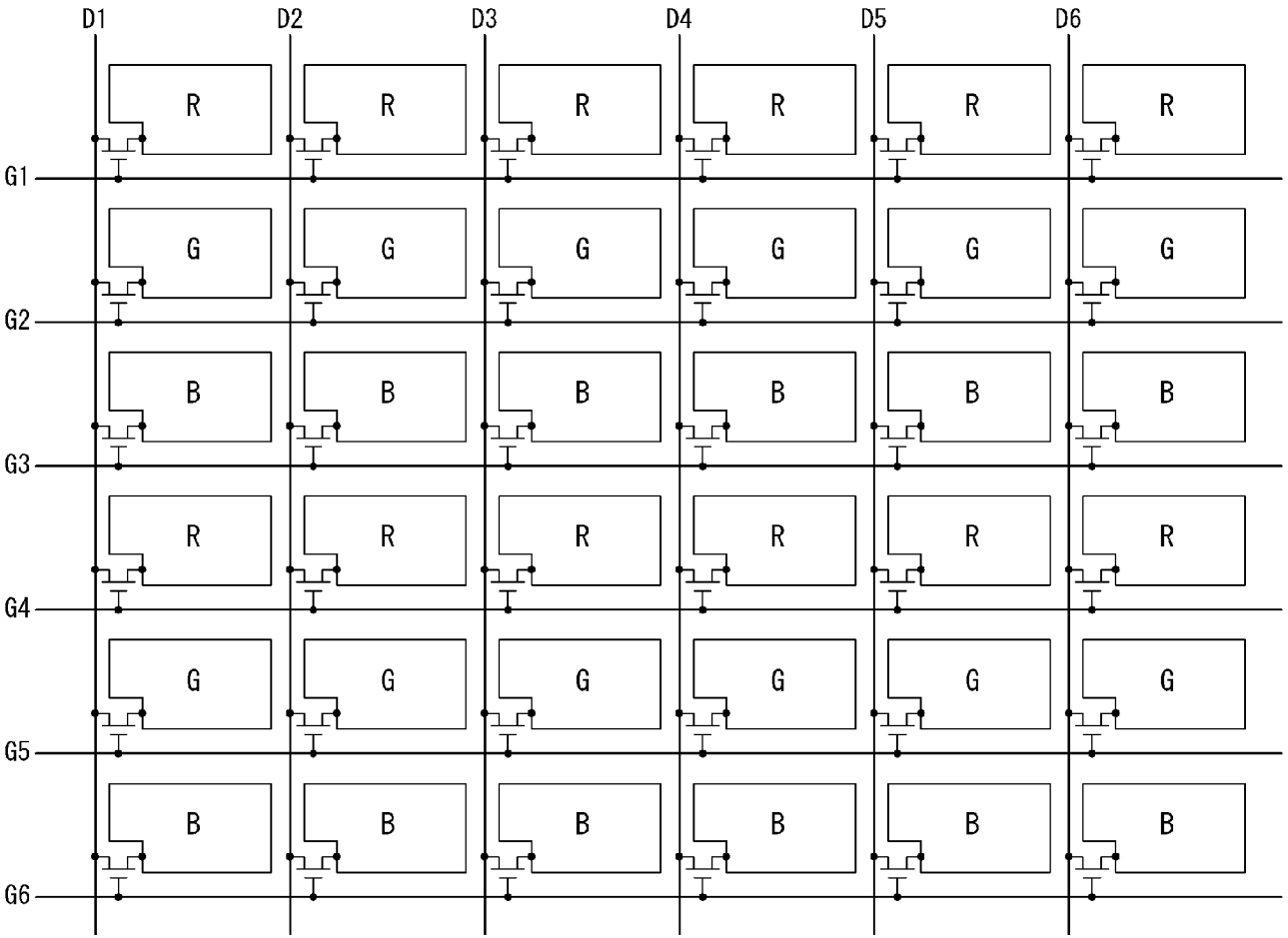

The liquid crystal display panel includes an upper glass substrate and a lower glass substrate that are positioned opposite each other with a liquid crystal layer interposed between the upper glass substrate and the lower glass substrate. The pixel array 10 includes liquid crystal cells arranged in a matrix format according to a crossing structure of data lines and gate lines of the liquid crystal display panel to display video data. The pixel array 10 includes a thin film transistor (TFT) formed at each of crossings of the data lines and the gate lines and pixel electrodes connected to the TFTs. The pixel array 10 may be variously implemented as illustrated in FIGS. 4 to 6. The liquid crystal display panel displays an image of the video data through a control of a transmitted amount of light by driving each of the liquid crystal cells of the pixel array 10 by a difference between a data voltage applied to the pixel electrodes through the TFTs and a common voltage applied to a common electrode through the TFT.

A black matrix, a color filter, and a common electrode are formed on the upper glass substrate of the liquid crystal display panel. The common electrode is formed on the upper glass substrate in a vertical electric field driving manner, such as a twisted nematic (TN) mode and a vertical alignment (VA) mode. The common electrode and the pixel electrode are formed on the lower glass substrate in a horizontal electric field driving manner, such as an in-plane switching (IPS) mode and a fringe field switching (FFS) mode.

Polarizing plates are respectively attached to the upper and lower glass substrates of the liquid crystal display panel. Alignment layers for setting a pre-tilt angle of liquid crystals are respectively formed on the upper and lower glass substrates.

The liquid crystal display panel applicable to the embodiment may be implemented in any liquid crystal mode as well as the TN, VA, IPS, and FFS modes. The liquid crystal display according to the embodiment may be implemented in any type liquid crystal display including a backlit liquid crystal display, a transflective liquid crystal display, and a reflective liquid crystal display. A backlight unit is necessary in the backlit liquid crystal display and the transflective liquid crystal display. The backlight unit may be implemented as a direct type backlight unit or an edge type backlight unit.

A plurality of data output channels of the integrated drive circuit chip 11 are respectively connected to the data lines of the pixel array 10 through link lines 15. The integrated drive circuit chip 11 converts digital video data received from an external system board (not shown) into positive and negative analog data voltages to supply the positive and negative analog data voltages to the data lines of the pixel array 10 through the data output channels. The integrated drive circuit chip 11 supplies a gate timing control signal and driving voltages required to drive the gate drive circuits 13A and 13B to the gate drive circuits 13A and 13B. The integrated drive circuit chip 11 may be mounted on a flexible circuit board 12, such as a flexible flat cable (FFC) and a flexible printed circuit board (FPCB). The flexible circuit board 12 may be connected to the link lines 15 formed on the lower glass substrate of the liquid crystal display panel through an anisotropic conductive film (ACF). An existing timing controller and existing source drive integrated circuits (ICs) are integrated into the integrated drive circuit chip 11. Examples of a circuit configuration and an operation of the integrated drive circuit chip 11 are disclosed in detail in Korea Patent Application Nos. 10-2007-0010487, 10-2007-0013378, 10-2007-0021605, and 10-2007-0030309 corresponding to the present applicant, and which are hereby incorporated by reference in their entirety. Therefore, a further description may be briefly made or may be entirely omitted.

The gate drive circuits 13A and 13B sequentially supply a gate pulse to the gate lines of the pixel array 10 in response to the gate timing control signal received from the integrated drive circuit chip 11. The gate drive circuits 13A and 13B may be mounted on a tape carrier package (TCP) and may be attached to the lower glass substrate of the liquid crystal display panel through a tape automated bonding (TAB) process. Further, the gate drive circuits 13A and 13B may be directly formed on the lower glass substrate of the liquid crystal display panel through a Gate In Panel (GIP) process at the same time as the forming of the pixel array 10. The gate drive circuits 13A and 13 may be positioned at both sides of the pixel array 10 as shown in FIG. 2 or may be positioned at one side of the pixel array 10.

Figure 8:
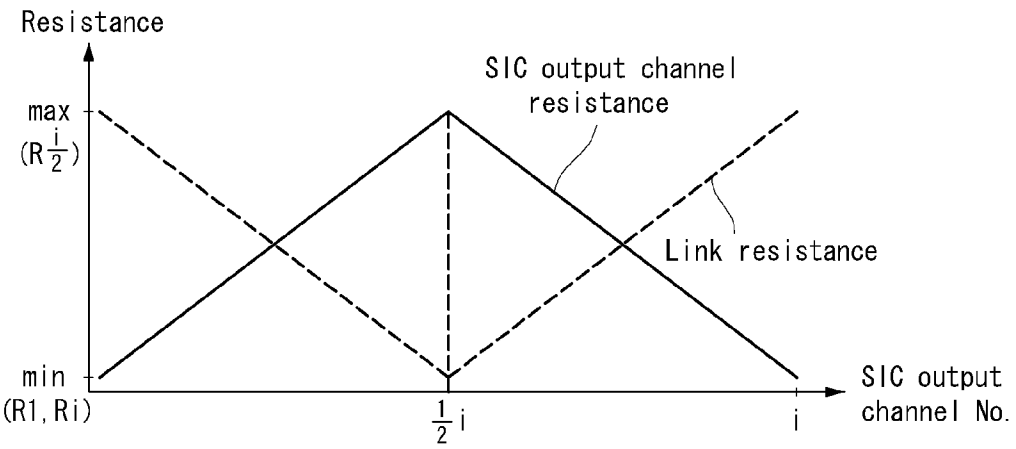
FIGS. 8 and 9 illustrate a resistance of an output channel of each of an integrated drive circuit chip and a source driver IC respectively shown in FIGS. 2 and 3 and a link resistance of a liquid crystal display panel.
Figure 9:
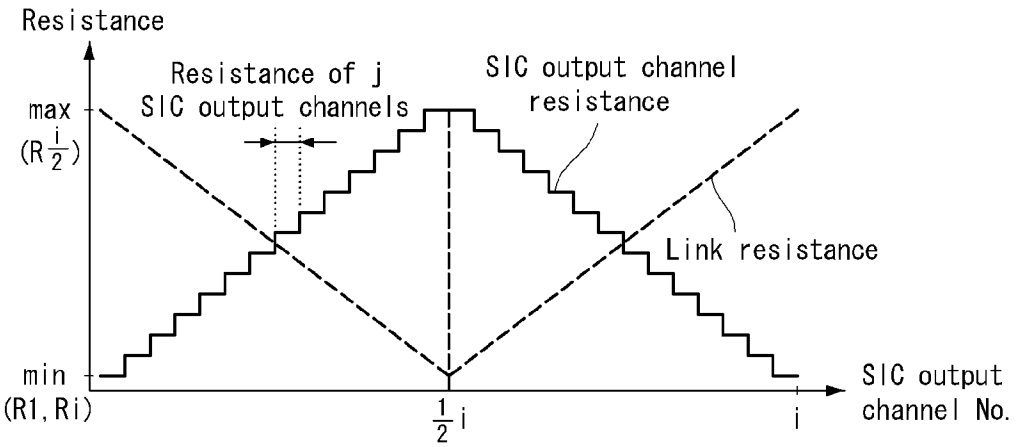

A link resistance of the liquid crystal display panel increases as a distance between the liquid crystal display panel and the integrated drive circuit chip 11 increases. To compensate for an increase in the link resistance, the embodiment allows at least some of resistances of the output channels of the integrated drive circuit chip 11 to be different from each other. For this, the integrated drive circuit chip 11 includes a plurality of output channel resistors therein as shown in FIGS. 7 to 11. A resistance of a middle output channel of the integrated drive circuit chip 11 connected to the data line formed at a location corresponding to ½ of a transverse length of the pixel array 10 is set to a maximum value as shown in FIGS. 8 and 9. On the other hand, as shown in FIGS. 8 and 9, the output channels of the integrated drive circuit chip 11 have a decreasing resistance as they go from the middle to both ends of the integrated drive circuit chip 11. Therefore, resistances of the output channels positioned at both ends of the integrated drive circuit chip 11 are set to a minimum value. Accordingly, because the resistances of the output channels of the integrated drive circuit chip 11 are inversely proportional to the link resistance of the liquid crystal display panel as shown in FIG. 8, a deviation of a drop amount of a data voltage supplied to the data lines of the pixel array 10 can be reduced. As a result, in the liquid crystal display according to the embodiment, a charge amount of the data voltage to which all of the liquid crystal cells of the pixel array 10 are charged is uniform, and the display quality of the liquid crystal display is uniform throughout the pixel array 10.

Figure 3:
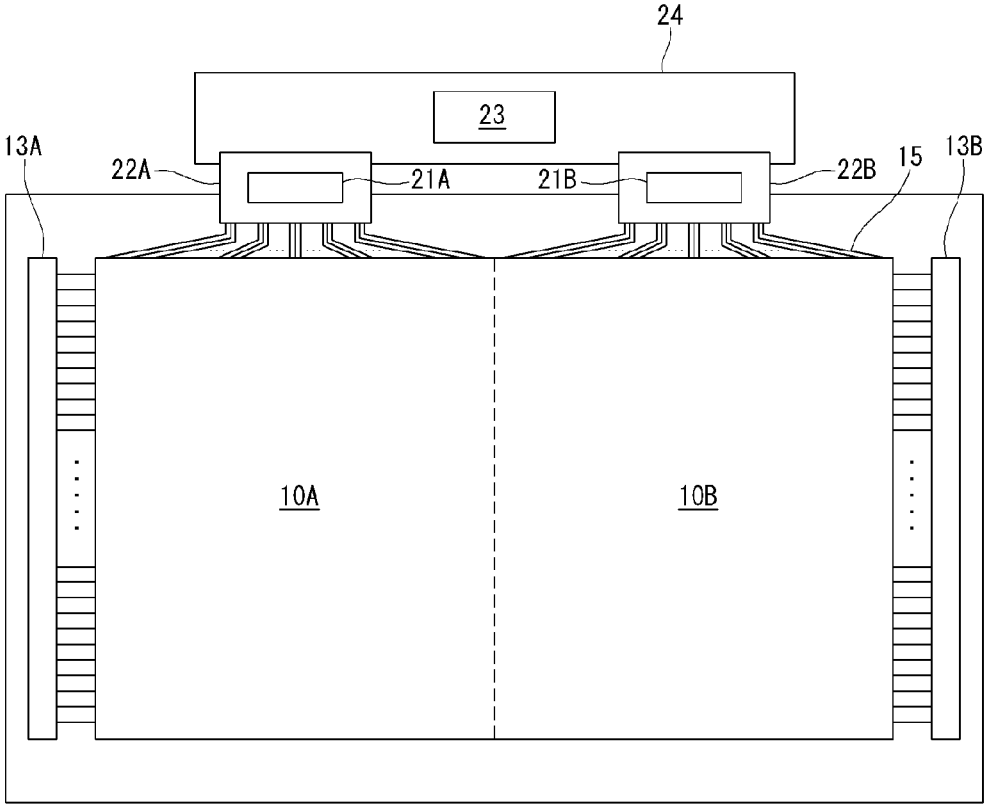
FIG. 3 illustrates a liquid crystal display according to another embodiment.

FIG. 3 illustrates a liquid crystal display according to another embodiment.

As shown in FIG. 3, a liquid crystal display includes a liquid crystal display panel on which pixel arrays 10A and 10B are formed, a plurality of source driver ICs 21A and 21B, gate drive circuits 13A and 13B, and a timing controller 23. A backlight unit may underlie the liquid crystal display panel to uniformly provide light to the liquid crystal display panel.

The liquid crystal display panel includes an upper glass substrate and a lower glass substrate that are positioned opposite each other with a liquid crystal layer interposed between the upper glass substrate and the lower glass substrate. The liquid crystal display panel includes the pixel arrays 10A and 10B each having the same circuit configuration as FIGS. 4 to 6 to display video data. Since a structure of the liquid crystal display panel shown in FIG. 3 is substantially the same as FIG. 2 and FIGS. 4 to 6, a further description may be briefly made or may be entirely omitted.

A plurality of data output channels of the source driver ICs 21A and 21B are respectively connected to data lines of the pixel array 10 through link lines 15. Each of the source driver ICs 21A and 21B receives digital video data from the timing controller 23. Then, each of the source driver ICs 21A and 21B converts the digital video data into positive and negative analog data voltages in response to a source timing control signal received from the timing controller 23 to supply the positive and negative analog data voltages to the data lines of the pixel array 10 through the data output channels. Each of the source driver ICs 21A and 21B may be attached to the lower glass substrate of the liquid crystal display panel through a chip on glass (COG) process. Further, each of the source driver ICs 21A and 21B may be attached to the lower glass substrate of the liquid crystal display panel through a TAB process.

The gate drive circuits 13A and 13B sequentially supply a gate pulse to gate lines of the pixel array 10 in response to a gate timing control signal received from the timing controller 23. The gate drive circuits 13A and 13B may be mounted on a TCP and may be attached to the lower glass substrate of the liquid crystal display panel through a TAB process. Further, the gate drive circuits 13A and 13B may be directly formed on the lower glass substrate of the liquid crystal display panel through a GIP process at the same time as the forming of the pixel array 10. The gate drive circuits 13A and 13 may be positioned at both sides of the pixel array 10 or at one side of the pixel array 10.

The timing controller 23 supplies the digital video data received from an external system board (not shown) to each of the source driver ICs 21A and 21B. The timing controller 23 generates the source timing control signal for controlling operation timing of the source driver ICs 21A and 21B and the gate timing control signal for controlling operation timing of the gate drive circuits 13A and 13B. The timing controller 23 is mounted on a control printed circuit board (PCB) 24. An input connector of the control PCB 24 is connected to the external system board through a flexible circuit board, and output pads of the control PCB 24 are connected to input pads of source TCPs 22A and 22B through an anisotropic conductive film (ACF), respectively.

A link resistance of the liquid crystal display panel increases as a distance between the liquid crystal display panel and the source driver ICs 21A and 21B increases. To compensate for an increase in the link resistance, the embodiment allows resistances of the output channels of each of the source driver ICs 21A and 21B to have different values. For this, each of the source driver ICs 21A and 21B includes a plurality of output channel resistors therein as shown in FIGS. 7 to 11. In the embodiment, a left half portion of the pixel array 10 receiving the data from the first source driver IC 21A is called a first pixel array 10A, and a right half portion of the pixel array 10 receiving the data from the second source driver IC 21B is called a second pixel array 10B. A resistance of a middle output channel of the first source driver IC 21A connected to the data line formed at a location corresponding to ½ of a transverse length of the first pixel array 10A (or at a location corresponding to ¼ of a transverse length of an entire pixel array including the first and second pixel arrays 10A and 10B) is set to a maximum value as shown in FIGS. 8 and 9. On the other hand, as shown in FIGS. 8 and 9, the output channels of the first source driver IC 21A have a decreasing resistance as they go from the middle to both ends of the first source driver IC 21A. Therefore, resistances of output channels positioned at both ends of the first source driver IC 21A are set to a minimum value. A resistance of a middle output channel of the second source driver IC 21B connected to the data line formed at a location corresponding to ½ of a transverse length of the second pixel array 10B (or at a location corresponding to ¾ of the transverse length of the entire pixel array) is set to a maximum value as shown in FIGS. 8 and 9. On the other hand, as shown in FIGS. 8 and 9, the output channels of the second source driver IC 21B have a decreasing resistance as they go from the middle to both ends of the second source driver IC 21B. Therefore, resistances of output channels positioned at both ends of the second source driver IC 21B are set to a minimum value. Accordingly, because the resistances of the output channels of each of the first and second source driver ICs 21A and 21B are inversely proportional to the link resistance of the liquid crystal display panel as shown in FIG. 8, a deviation of a drop amount of a data voltage supplied to the data lines of the first and second pixel arrays 10A and 10B can be reduced. As a result, in the liquid crystal display, a charge amount of the data voltage to which all of liquid crystal cells of the first and second pixel arrays 10A and 10B are charged is uniform, and the display quality of the liquid crystal display is uniform throughout the first and second pixel arrays 10A and 10B.

Each of the integrated drive circuit chip 11 and the source driver ICs 21A and 21B may include a multichannel selection circuit therein. The multichannel selection circuit selectively enables or disables some of the output channels in response to a multichannel selection signal supplied through an option pin of each of the integrated drive circuit chip 11 and the source driver ICs 21A and 21B. The output channels enabled by the multichannel selection circuit are connected to the data lines and thus serve as a data output channel capable of normally supplying the data voltage to the data lines. On the other hand, the output channels disabled by the multichannel selection circuit serve as a dummy output channel not outputting the data voltage. In the integrated drive circuit chip 11 and the source driver ICs 21A and 21B each including the multichannel selection circuit, some output channels may serve as the dummy output channel. In this case, the resistances of the output channels of each of the integrated drive circuit chip 11 and the source driver ICs 21A and 21B may not have a resistance pattern shown in FIGS. 8 and 9. For example, if the multichannel selection circuit disables an output channel at a right end of each of the integrated drive circuit chip 11 and the source driver ICs 21A and 21B, a resistance of the disabled output channel (i.e., the dummy output channel) at the right end may be greater than a resistance of an output channel at a left end of each of the integrated drive circuit chip 11 and the source driver ICs 21A and 21B. In other words, in the integrated drive circuit chip 11 and the source driver ICs 21A and 21B each including the multichannel selection circuit, the resistance of the output channel at the left end may be substantially equal to or different from the resistance of the output channel at the right end depending on a location of the dummy output channel. Examples of the multichannel selection circuit are disclosed in detail in Korean Patent Application Nos. 10-2004-0029611, 10-2004-0029612, 10-2004-0029615, and 10-2003-0090301 and U.S. Pat. Nos. 7,492,343 and 7,495,648 corresponding to the present applicant, and which are hereby incorporated by reference in their entirety.

FIGS. 4 to 6 illustrate various examples of the pixel arrays 10, 10A, and 10B shown in FIGS. 2 and 3. More specifically, FIGS. 4 to 6 are equivalent circuit diagrams of a portion of a pixel array.

A pixel array shown in FIG. 4 has a structure applicable to a general liquid crystal display. More specifically, the pixel array shown in FIG. 4 has the structure in which data lines D1 to D6 cross gate lines G1 to G4, and liquid crystal cells of red subpixels R, liquid crystal cells of green subpixels G, and liquid crystal cells of blue subpixels B are arranged in a column direction. In the pixel array shown in FIG. 4, each of TFTs supplies a data voltage from the data lines D1 to D6 to a pixel electrode of the liquid crystal cell on the left (or on the right) of each of the data lines D1 to D6 in response to a gate pulse from the gate lines G1 to G4. Further, in the pixel array shown in FIG. 4, 1 pixel includes a red subpixel R, a green subpixel G, and a blue subpixel B that are arranged adjacent to one another along a row direction (or a line direction) orthogonal to the column direction. When a resolution of the pixel array shown in FIG. 4 is m×n, m×3 (where "3" corresponds to three subpixels R, G, and B constituting 1 pixel) data lines and n gate lines are necessary. A gate pulse of 1 horizontal period synchronized with the data voltage is sequentially supplied to the gate lines of the pixel array shown in FIG. 4.

At the same resolution, the number of data lines required in a pixel array shown in FIG. 5 may be reduced to one half of the number of data lines required in the pixel array shown in FIG. 4. Further, the number of source driver ICs required in the pixel array of FIG. 5 may be reduced to one half of the number of source driver ICs required in the pixel array of FIG. 4. In the pixel array shown in FIG. 5, liquid crystal cells of red subpixels R, liquid crystal cells of green subpixels G, and liquid crystal cells of blue subpixels B are arranged in a column direction. Further, 1 pixel includes a red subpixel R, a green subpixel G, and a blue subpixel B that are arranged adjacent to one another along a row direction (or a line direction) orthogonal to the column direction. In the pixel array shown in FIG. 5, liquid crystal cells at both sides of one data line are successively charged to the data voltage supplied through the same data line in a time-division manner. In the pixel array shown in FIG. 5, liquid crystal cells and TFTs on the left of each of data lines D1 to D4 are respectively called a first liquid crystal cell and a first TFT T1, and liquid crystal cells and TFTs on the right of each of the data lines D1 to D4 are respectively called a second liquid crystal cell and a second TFT T2. Each of the first TFTs T1 supplies a data voltage from data lines D1 to D4 to a pixel electrode of the first liquid crystal cell in response to a gate pulse from odd-numbered gate lines G1, G3, G5, and G7. In each of the first TFTs T1, a gate electrode is connected to the odd-numbered gate lines G1, G3, G5, and G7, a drain electrode is connected to the data lines D1 to D4, and a source electrode is connected to the pixel electrode of the first liquid crystal cell. Each of the second TFTs T2 supplies the data voltage from the data lines D1 to D4 to a pixel electrode of the second liquid crystal cell in response to a gate pulse from even-numbered gate lines G2, G4, G6 and G8. In each of the second TFTs T2, a gate electrode is connected to the even-numbered gate lines G2, G4, G6 and G8, a drain electrode is connected to the data lines D1 to D4, and a source electrode is connected to the pixel electrode of the second liquid crystal cell. When a resolution of the pixel array shown in FIG. 5 is m×n, (m×3)/2 (where "3" corresponds to three subpixels R, G, and B constituting 1 pixel) data lines and 2n gate lines are necessary. A gate pulse of ½ horizontal period synchronized with the data voltage is sequentially supplied to the gate lines of the pixel array shown in FIG. 5.

At the same resolution, the number of data lines required in a pixel array shown in FIG. 6 may be reduced to ⅓ of the number of data lines required in the pixel array shown in FIG. 4. Further, the number of source driver ICs required in the pixel array of FIG. 6 may be reduced to ⅓ of the number of source driver ICs required in the pixel array of FIG. 4. In the pixel array shown in FIG. 6, liquid crystal cells of red subpixels R, liquid crystal cells of green subpixels G, and liquid crystal cells of blue subpixels B are arranged in a line direction. In the pixel array shown in FIG. 6, 1 pixel includes a red subpixel R, a green subpixel G, and a blue subpixel B that are arranged adjacent to one another along a column direction. In the pixel array shown in FIG. 6, each of TFTs supplies a data voltage from data lines D1 to D6 to a pixel electrode of the liquid crystal cell on the left (or on the right) of each of the data lines D1 to D6 in response to a gate pulse from gate lines G1 to G6. When a resolution of the pixel array shown in FIG. 6 is m×n, m data lines and 3n gate lines are necessary. A gate pulse of ⅓ horizontal period synchronized with the data voltage is sequentially supplied to the gate lines of the pixel array shown in FIG. 6.

Figure 7:
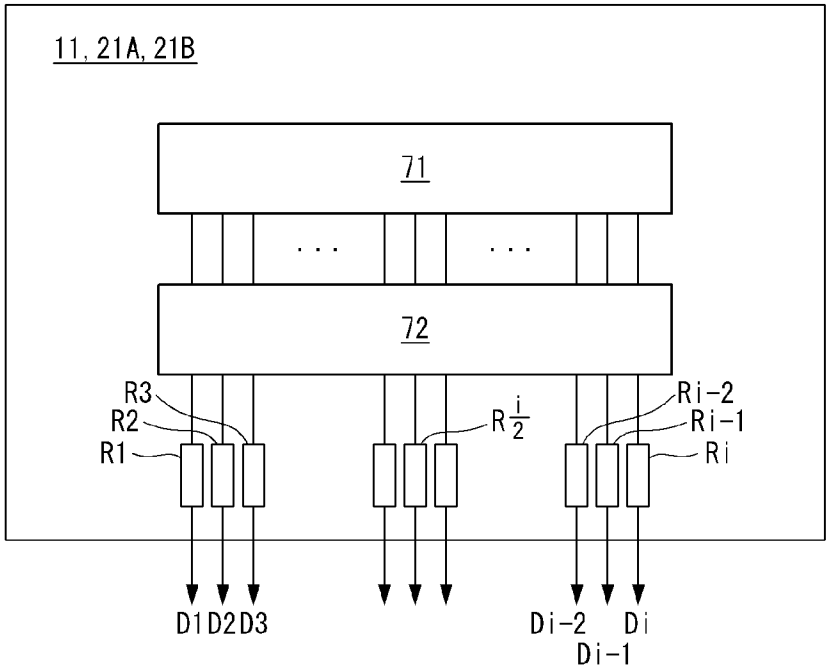
FIG. 7 is a block diagram illustrating a circuit configuration of an output unit of each of an integrated drive circuit chip and a source driver integrated circuit (IC) respectively shown in FIGS. 2 and 3.

FIG. 7 illustrates output channel resistors included in each of the integrated drive circuit chip 11 and the source driver ICs 21A and 21B. More specifically, FIG. 7 illustrates only an output unit of each of the integrated drive circuit chip 11 and the source driver ICs 21A and 21B related to the embodiments. Configurations of each of the integrated drive circuit chip 11 and the source driver ICs 21A and 21B except the output unit are substantially the same as known configurations.

As shown in FIG. 7, an output unit of each of the integrated drive circuit chip 11 and the source driver ICs 21A and 21B includes a digital-to-analog convertor (DAC) 71 and an output circuit 72.

The DAC 71 receives positive and negative gamma reference voltages and digital video data. The DAC 71 converts the digital video data received from a latch (not shown) into positive and negative analog data voltages using the positive and negative gamma reference voltages. The DAC 71 alternately supplies the positive and negative analog data voltages to the output circuit 72 through a multiplexer that alternately selects the positive and negative analog data voltages in response to a polarity control signal. The polarity control signal is generated in a logic circuit inside the integrated drive circuit chip 11 in FIG. 2. Further, the polarity control is generated in the timing controller 23 and then is input to the source driver ICs 21A and 21B in FIG. 3.

The output circuit 72 includes the above-described multichannel selection circuit and an output buffer having an offset removing unction. The multichannel selection circuit may be omitted in the output circuit 72. Output channels of the output circuit 72 are respectively connected to output channel resistors R1 to Ri for compensating for the link resistance of the liquid crystal display panel. The multichannel selection circuit selectively enables or disables the output channels of the integrated drive circuit chip 11 or the output channels of the source driver ICs 21A and 21B in response to the multichannel selection signal. The output buffer removes an offset component from the data voltage of the output channels to thereby reduce signal attenuation and supplies the data voltage to data lines D1 to Di, where "i" is a positive integer. The data line is not connected to a dummy output channel disabled by the multichannel selection circuit, and thus the data voltage is not output to the dummy output channel. The output channel resistors R1 to Ri are respectively connected to the output channels of each of the integrated drive circuit chip 11 and the source driver ICs 21A and 21B and thus each have a resistance inversely proportional to the link resistance of the liquid crystal display panel as shown in FIGS. 7 and 8. For example, while a resistance of a middle output channel resistor Ri/2 connected to the link line having a minimum link resistance is set to a maximum value, resistances of two end output channel resistors R1 and Ri connected to the link lines at both sides of the liquid crystal display panel having a maximum link resistance is set to a minimum value. The output channel resistors R1 to Ri have linearly decreasing resistances as shown in FIG. 8 as they go from the middle output channel resistor Ri/2 to each of the two end output channel resistors R1 and Ri. Further, as shown in FIG. 9, j (where j is an integer equal to or greater than 2 and less than 5) output channel resistors of the output channel resistors R1 to Ri have the same resistance, and thus the resistances of the output channel resistors R1 to Ri may be stepwise reduced.

FIGS. 8 and 9 are graphs illustrating a resistance of the output channel of each of the integrated drive circuit chip 11 and the source driver ICs 21A and 21B and a link resistance of the liquid crystal display panel.

As shown in FIG. 8, the link line of the liquid crystal display panel at a location corresponding to the middle output channel of each of the integrated drive circuit chip 11 and the source driver ICs 21A and 21B is measured to a minimum link resistance. On the other hand, the link lines have a linearly increasing link resistance as they go from the middle output channel to the two end output channels of each of the integrated drive circuit chip 11 and the source driver ICs 21A and 21B. Thus, two end link lines corresponding to two end output channels of each of the integrated drive circuit chip 11 and the source driver ICs 21A and 21B are measured to a maximum link resistance. To uniformize a charge amount of the data voltage of the liquid crystal cells throughout the pixel array 10 by compensating for the link resistances, the resistance of the middle output channel of each of the integrated drive circuit chip 11 and the source driver ICs 21A and 21B is set to a maximum value, and the output channels of each of the integrated drive circuit chip 11 and the source driver ICs 21A and 21B have linearly decreasing resistances as they go from the middle output channel to the two end output channels of each of the integrated drive circuit chip 11 and the source driver ICs 21A and 21B, and thus, two end output channels of each of the integrated drive circuit chip 11 and the source driver ICs 21A and 21B are set to a maximum resistance.

As shown in FIG. 8, because the resistances of the output channels of each of the integrated drive circuit chip 11 and the source driver ICs 21A and 21B have the linearity, the level of difficulty in manufacturing the integrated drive circuit chip 11 and the source driver ICs 21A and 21B is relatively high. To obtain a link resistance compensation effect similar to the resistance characteristic of the output channels illustrated in FIG. 8 and to reduce the level of manufacturing difficulty, in the embodiment, as shown in FIG. 9, the output channels of each of the integrated drive circuit chip 11 and the source driver ICs 21A and 21B may have stepwise changing resistances. More specifically, in each of the integrated drive circuit chip 11 and the source driver ICs 21A and 21B, 2 to 5 output channels may have the same resistance as shown in FIG. 9. In FIG. 9, the resistance of the middle output channel of each of the integrated drive circuit chip 11 and the source driver ICs 21A and 21B has to be set to a maximum value, and the output channels of each of the integrated drive circuit chip 11 and the source driver ICs 21A and 21B have to have stepwise decreasing resistances as they go from the middle output channel to the two end output channels of each of the integrated drive circuit chip 11 and the source driver ICs 21A and 21B, and thus, two end output channels of each of the integrated drive circuit chip 11 and the source driver ICs 21A and 21B have to be set to a maximum resistance.

Each of the output channel resistors R1 to Ri of each of the integrated drive circuit chip 11 and the source driver ICs 21A and 21B may have a fixed resistance under the condition that the resistances of the output channel resistors R1 to Ri are inversely proportional to the link resistances. However, link resistance characteristics in different types of liquid crystal displays are different from one another depending on a resolution of a liquid crystal display panel, the structure of the pixel array, and the like. The resistances of the output channel resistors of each of the integrated drive circuit chip 11 and the source driver ICs 21A and 21B have to be adjusted to be suitable for the different link resistance characteristics, so that the integrated drive circuit chip 11 and the source driver ICs 21A and 21B are commonly used in the different types of liquid crystal displays each having a different link resistance characteristic.

Figure 10:
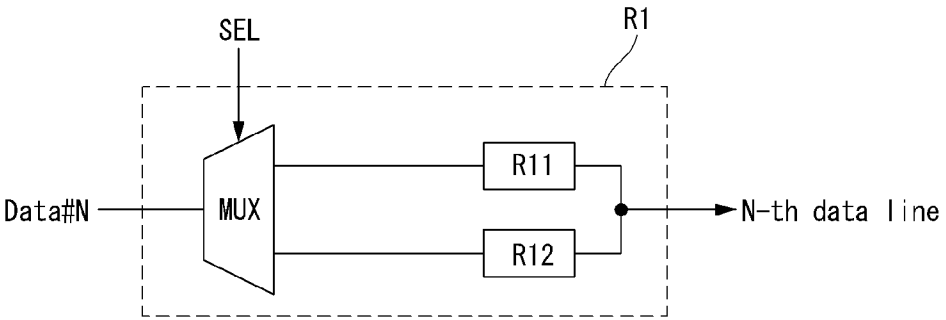
FIG. 10 is a circuit diagram of a variable resistance circuit implemented as an output channel resistor of each of an integrated drive circuit chip and a source driver IC respectively shown in FIGS. 2 and 3.
Figure 11:
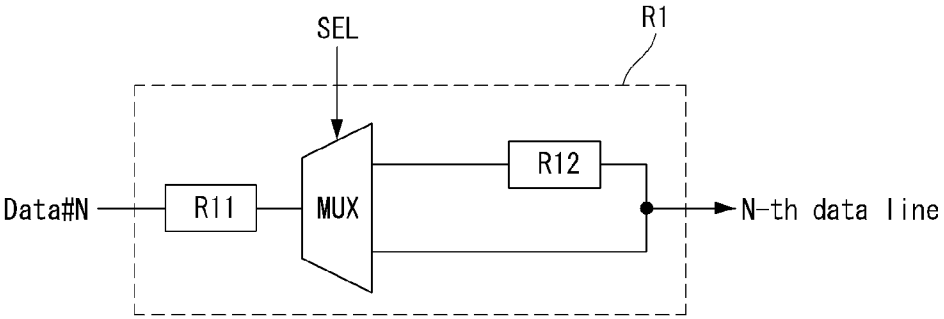
FIG. 11 is a circuit diagram of another variable resistance circuit implemented as an output channel resistor of each of an integrated drive circuit chip and a source driver IC respectively shown in FIGS. 2 and 3.

Each of the output channel resistors of each of the integrated drive circuit chip 11 and the source driver ICs 21A and 21B may be implemented as a variable resistance circuit as shown in FIGS. 10 and 11, so that the integrated drive circuit chip 11 and the source driver ICs 21A and 21B are commonly used and are compatible in different types of liquid crystal displays each having a different link resistance characteristic.

As shown in FIG. 10, a variable resistance circuit includes a multiplexer MUX, a first resistor R11 connected between a first output terminal of the multiplexer MUX and an N-th data line, and a second resistor R12 connected between a second output terminal of the multiplexer MUX and the N-th data line. Resistances of the first and second resistors R11 and R12 are different from each other, and at least one of the resistances of the first and second resistors R11 and R12 may be set to a variable resistance.

The output circuit 72 of the integrated drive circuit chip 11 or the source driver ICs 21A and 21B inputs an N-th positive/negative data voltage Data#N to an input terminal of the multiplexer MUX. The multiplexer MUX connects the input terminal of the multiplexer MUX to the first resistor R11 connected to the first output terminal of the multiplexer MUX or connects the input terminal to the second resistor R12 connected to the second output terminal of the multiplexer MUX in response to a resistance selection signal SEL input to a control terminal of the multiplexer MUX. If the resistance selection signal SEL is a high logic voltage, the multiplexer MUX connects the input terminal of the multiplexer MUX to the first resistor R11 having a relatively large (or small) resistance. If the resistance selection signal SEL is a low logic voltage, the multiplexer MUX connects the input terminal of the multiplexer MUX to the second resistor R12 having a relatively small (or large) resistance.

As shown in FIG. 11, a variable resistance circuit includes a first resistor R11, a multiplexer MUX whose an input terminal and a first output terminal are respectively connected to the first resistor R11 and an N-th data line, and a second resistor R12 connected between a second output terminal of the multiplexer MUX and the N-th data line. Resistances of the first and second resistors R11 and R12 are substantially equal to or different from each other, and at least one of the resistances of the first and second resistors R11 and R12 may be set to a variable resistance.

The output circuit 72 of the integrated drive circuit chip 11 or the source driver ICs 21A and 21B inputs an N-th positive/negative data voltage Data#N to the first resistor R11. The multiplexer MUX connects in series the first resistor R11 to the second resistor R12 or connects the first resistor R11 to the N-th data line in response to a resistance selection signal SEL input to a control terminal of the multiplexer MUX. If the resistance selection signal SEL is a high logic voltage, the multiplexer MUX connects in series the first resistor R11 to the second resistor R12. In this case, a resistance of the output channels of each of the integrated drive circuit chip 11 and the source driver ICs 21A and 21B increases to R11+R12. If the resistance selection signal SEL is a low logic voltage, the multiplexer MUX connects the first resistor R11 to the N-th data line. In this case, a resistance of the output channels of each of the integrated drive circuit chip 11 and the source driver ICs 21A and 21B decreases to R11.

In FIGS. 10 and 11, the control terminal of the multiplexer MUX may be connected to a power voltage source or a ground level voltage source through an option pin and a dip switch installed in each of the integrated drive circuit chip 11 and the source driver ICs 21A and 21B. If the power voltage source supplies a power voltage to the control terminal of the multiplexer MUX, the high logic voltage as the resistance selection signal SEL is input to the control terminal of the multiplexer MUX. If the ground level voltage source supplies a ground level voltage to the control terminal of the multiplexer MUX, the low logic voltage as the resistance selection signal SEL is input to the control terminal of the multiplexer MUX.

The resistance selection signal SEL may be generated in a system board and may be input to a resistance selection option pin of the integrated drive circuit chip 11. Further, the resistance selection signal SEL may be generated in a system board and may be input to a resistance selection option pin of the source driver ICs 21A and 21B through the timing controller 23.

As described above, the liquid crystal display can compensate for a deviation of the link resistances of the liquid crystal display panel by connecting the output channel resistors each having a variable resistance to the output channels of the source driver IC. Accordingly, the uniform display quality throughout the pixel array can be achieved.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel including data lines and gate lines crossing one another and a pixel array including liquid crystal cells arranged in a matrix format according to a crossing structure of the data lines and the gate lines;

a source drive circuit including a plurality of output channels, the source drive circuit supplying a data voltage to the data lines through the plurality of output channels;

a gate drive circuit sequentially supplying a gate pulse to the gate lines, wherein the liquid crystal display panel includes link lines that respectively connect the data lines to the output channels of the source drive circuit, wherein the source drive circuit includes a plurality of output channel resistors connected between the output channels and the link lines, wherein each of the output channel resistors includes a variable resistance circuit, wherein the variable resistance circuit includes:

a first resistor to which the data voltage is input;

a multiplexer whose an input terminal is connected to the first resistor; and a second resistor connected to one of a plurality of output terminals of the multiplexer, wherein the second resistor and another output terminal of the plurality of output terminals of the multiplexer are connected in series to the data line, wherein the multiplexer connects the first resistor to one of the second resistor and the data line in response to a predetermined resistance selection signal.

2. The liquid crystal display of claim 1, wherein resistances of the output channel resistors are inversely proportional to resistances of the link lines.

3. The liquid crystal display of claim 1, wherein the source drive circuit includes a circular integrated drive circuit chip supplying the data voltage to all of the data lines inside the pixel array.

4. The liquid crystal display of claim 3, wherein the circular integrated drive circuit chip includes a digital-to-analog converter converting digital video data into the data voltage and an output circuit connecting an output of the digital-to-analog converter to the output channel resistors through an output buffer.

5. The liquid crystal display of claim 4, wherein the output circuit includes a multichannel selection circuit that disables at least some of the output channels in response to a predetermined multichannel selection signal so that the at least some of the output channels serve as a dummy output channel.

6. The liquid crystal display of claim 1, wherein the source drive circuit includes:

at least one source driver integrated circuit (IC) connected to the data lines through the output channels; and a timing controller that supplies digital video data to the at least one source driver IC and generates a timing control signal for controlling an operation timing of the at least one source driver IC and an operation timing of the gate drive circuit.

7. The liquid crystal display of claim 6, wherein the at least one source driver IC includes a digital-to-analog converter converting the digital video data into the data voltage and an output circuit connecting an output of the digital-to-analog converter to the output channel resistors through an output buffer.

8. The liquid crystal display of claim 7, wherein the output circuit includes a multichannel selection circuit that disables at least some of the output channels in response to a predetermined multichannel selection signal so that the at least some of the output channels serve as a dummy output channel.

9. The liquid crystal display of claim 1, wherein adjacent j, where j is an integer equal to or greater than 2 and less than 5, output channel resistors among the plurality of output channel resistors have the same resistance.

* * * * *